US005203930A

United States Patent [19]

Blümlhuber et al.

[11] Patent Number: 5,203,930

[45] Date of Patent: Apr. 20, 1993

[54] PROCESS OF FORMING PHOSPHATE COATINGS ON METAL SURFACES

[75] Inventors: Georg Blümlhuber, Oberasbach; Horst Gehmecker, Hofheim; Dieter Hauffe, Frankfurt am Main; Lothar Kaul, Karben; Thomas Nitschke, Flörsheim; Werner Rausch, Oberursel; Hardy Wietzoreck, Frankfurt am Main, all of Fed. Rep. of Germany

[73] Assignee: Metallgesellschaft Aktiengesellschaft, Frankfurt am Main, Fed. Rep. of Germany

[21] Appl. No.: 570,350

[22] Filed: Aug. 21, 1990

[30] Foreign Application Priority Data

Aug. 22, 1989 [DE] Fed. Rep. of Germany ..... 3927613

[51] Int. Cl.[5] ..... C23C 22/12

[52] U.S. Cl. ..... 148/262; 148/263

[58] Field of Search ..... 148/262, 263

[56] References Cited

U.S. PATENT DOCUMENTS 4,824,490 4/1989 Oei ..... 148/260

5,039,361 8/1991 Hauffe ..... 148/262

FOREIGN PATENT DOCUMENTS 1361489 7/1974 United Kingdom ..... 148/262

*Primary Examiner*—Sam Silverberg

*Attorney, Agent, or Firm*—Felfe & Lynch

[57] ABSTRACT

A process for forming phosphate coatings on metal surfaces is provided which comprises the steps of contacting said metal surface with an Fe(II)-containing phosphating solution comprising 0.4 to 30 g/l Zn 4 to 30 g/l $P_2O_5$ 5 to 50 g/l $NO_3$ up to 10 g/l Fe(II) ; and up to 0.3 g/l (Fe(III)

wherein the weight ratio of free $P_2O_5$ to total $P_2O_5$ is (0.04 to 0.50) : 1 and, replenishing said phosphating solution with Zn, $NO_3$ and $P_2O_5$ in a weight ratio of Zn : $NO_3$ $P_2O_5$ =(0.60 to 0.30) : (0.2 to 0.4) : 1 wherein the Fe(II) content is adjusted by oxidation with nitrate or nitrite derived from nitrate optionally employed with an oxygen-containing gas, $H_2O_2$ and/or nitrous gases; and rinsing said metal surface with a cascade of at least two aqueous rinsing baths in the opposite direction of travel of said metal surface wherein water having a low salt content or no salt content derived from the phosphating bath is fed to the last rinsing bath and the overflowing water from said rinsing bath is fed to the next preceding rinsing bath and ultimately to the phosphating bath, and wherein the low salt content rinse water derived from the phosphating bath is withdrawn therefrom as a rate effective to permit the addition of phosphate-enriched rinsing water from the cascade of rinsing water to the phosphating bath while maintaining the desired species concentration in said phosphating bath.

18 Claims, No Drawings

PROCESS OF FORMING PHOSPHATE COATINGS ON METAL SURFACES

FIELD OF THE INVENTION

This invention relates to a process of forming phosphate coatings on metal surfaces by treatment with aqueous zinc phosphate solutions containing iron (II) and nitrate ions, and which is waste water-free.

BACKGROUND OF THE INVENTION

In the metal-working industry, processes of forming phosphate coatings by a treatment with aqueous zinc phosphate solutions are used on a large scale. Phosphate coatings formed on metal surfaces which have been treated by such processes serve particularly to reduce sliding friction; to facilitate cold-working; to protect against corrosion; and as a base for paints.

Such phosphate baths usually have a pH value of about 1.8 to about 3.8 and contain mainly zinc and phosphate ions as operative ingredients. In addition to zinc cations, other cations, such as ammonium, calcium, cobalt, iron, potassium, copper, sodium, magnesium, manganese, may be present in such processes. To accelerate the formation of the phosphate layer, oxidizers, such as bromate, chlorate, nitrate, nitrite, organic nitro compounds, perborate, persulfate, hydrogen peroxide, are generally added to the phosphating baths. It is also possible to use an oxygen-containing gas to oxidize iron(II) to iron(III). In order to optimize the formation of the phosphate layer on certain materials, additives consisting, e.g., of fluoride, silicon fluoride, boron fluoride, citrate and tartrate, may be used. The large number of individual ingredients and of their possible combinations permits a large number of different compositions to be used in a phosphating bath.

Such phosphating baths are usually contacted with the workpiece surface to be treated by dipping, flooding or spraying. During the contacting time, which may amount to between a few seconds and half an hour or more, the chemical reaction with the metal surface results in the formation of crystalline phosphate layers which are firmly intergrown with the metal. Because any residual phosphating solution on the surface would disturb further processing, the phosphating treatment is succeeded by a thorough rinsing with water. In order to avoid a detrimental enrichment of the ingredients of the phosphating baths in the rinsing baths, the latter are replenished with fresh water and contaminated rinsing water is withdrawn as an overflow. The contaminated rinsing water contains pollutants and for this reason must be specially treated before it can be delivered to sewer or to a receiving body of water.

As the need for treatment and disposal of spent rinsing water constitutes a disadvantage in the use of phosphating processes, it has been proposed, e.g., in DE-C-23 27 304, to use a zinc phosphating process in which solutions are employed which are so composed that virtually all components can be precipitated by a treatment with $Ca(OH)_2$. This will greatly facilitate the processing of the rinsing water and will afford the advantage that the processed rinsing water is of high quality and can be re-used in the process. A disadvantage resides, however, in that the required precipitability involves a strong restriction as regards the adaptation of the composition of the phosphating bath to the requirements encountered in practice.

It has been suggested in F. Wilhelm (Metalloberfläche, 33 (1979), pages 301 to 307) to effect a cascade rinsing after zinc phosphating and to save so much water that the rinsing water can be used to compensate losses from the zinc phosphating zone. However, it is also stated in this reference that such a concept cannot be reduced to practice for reasons of process technology and economy.

It is therefore an object of this invention to provide a process for the formation of phosphate coatings on metals, particularly on steel, galvanized steel, zinc alloy-plated steel, aluminized steel and aluminum by a treatment with zinc phosphate solutions which contain iron(II) and nitrate ions which is waste water-free and which avoids known disadvantages, particularly those mentioned hereinabove. Additional objects and advantages of the invention will be apparent from the following discussion.

SUMMARY OF THE INVENTION

In accordance with the present invention a process for forming a phosphate coating on a metal surface is provided which comprises contacting said metal surface with a phosphating solution comprising:

| | |
|---|---|
| 0.4 to 30 | g/l Zn; |
| 4 to 30 | g/l $P_2O_5$; |
| 5 to 50 | g/l $NO_3$; |
| up to 10 | g/l Fe(II); and |
| up to 0.3 | g/l Fe(III) |

wherein the weight ratio of free $P_{25}$ to total $P_2O_5$ is (0.04 to 0.50): 1, and replenishing said phosphating solution with Zn, $NO_3$ and $P_2O_5$ in a weight ratio of $$Zn\ NO_3P_2O=(0.80 \text{ to } 0.30):(0.17 \text{ to } 0.4):1,$$

preferably $$(0.60 \text{ to } 0.40):(0.20 \text{ to } 0.35):1;$$

and wherein the Fe(II) content is adjusted by oxidation with nitrate, or nitrite derived from nitrate, optionally employed with an oxygen-containing gas $H_2O_2$ and/or nitrous gases. The phosphating bath is succeeded by a cascade of at least two rinsing baths in the opposite direction of travel of the workpieces. Low-salt water or preferably salt-free water is fed to the last cascading rinsing bath. The overflowing water from the rinsing baths is fed in succession to the next preceding rinsing bath and ultimately to the phosphating bath, and the aforesaid low-salt or salt-free water is withdrawn from the phosphating bath at such a rate that the phosphate-enriched rinsing water from the cascade can be fed to the phosphating bath while maintaining the desired species concentrations therein.

DETAILED DESCRIPTION OF THE INVENTION

In accordance with the invention the expression "waste water-free" means that no water from the rinsing baths will be discharged to a sewer or other receiving body of water in order to avoid an enriching of undesired chemicals in the phosphating bath.

The process in accordance with the invention is particularly intended for the surface treatment of iron and steel, low-alloy steel, galvanized steel, zinc alloy-plated steel, i.e., steel plated with ZnAl, ZnFe and ZnNi, and of aluminized steel, aluminum and its alloys.

The phosphating solutions of the present inventive process comprise mainly Zn, $P_2O_5$ and $NO_3$. Other cations and/or anions may also be present. Phosphating solutions which must be replenished during the processing to maintain predetermined concentrations of bromate, chlorate, organic nitro compounds, perborate and/or persulfate are unsuitable in the waste water processing in accordance with the invention. Further, processes in which alkali nitrite as an accelerator must be added from time to time or continuously are also unsuitable.

In a preferred embodiment of the present inventive process the phosphating solution additionally comprises,

| | |
|---|---|
| up to 10 | g/l Mg; |
| up to 20 | g/l Ca; |
| up to 20 | g/l Mn; |
| up to 20 | g/l Ni; |
| up to 10 | g/l Co; |
| up to 0.02 | g/l Cu; |
| up to 20 | g/l Na and/or K and or $NH_4$; |
| up to 8 | g/l $SiF_6$; |
| up to 8 | g/l $BF_4$; |
| up to 5 | g/l F; |
| up to 10 | g/l Cl. |

In accordance with a further preferred embodiment of the present inventive process, a metal surface to be treated is contacted with the aforesaid phosphating solution in which the weight ratio (Mg+Ca+Mn+Ni+Co) : Zn is equal to or lower than 4:1 and which is replenished with the ingredients Mg, Ca, Mn, Fe, Ni, Co and Cu in a molar ratio (Mg+Ca+Mn+Fe+Ni+Co+Cu) : Zn which is equal to or lower than 2.

Of the afore-mentioned cations which are optionally contained in the phosphating baths, Fe(II) is not added as a chemical in most cases but during treatment of iron or steel becomes enriched as a result of the resulting pickling action, unless said Fe(II) is transformed to a trivalent state by oxidizing agents and is precipitated as iron(III) phosphate.

Fe(III) contained in the baths serves, inter alia, to stabilize the equilibrium for the phosphating reaction. Owing to the co-use of Mg and/or Ca and/or Mn, phosphate coatings are obtained which contain said cations in addition to Zn and optionally Fe(II). Such mixed phosphates are distinguishable by virtue of having a higher resistance to alkali, and for this reason are particularly suitable as a base for paints. They have also proved satisfactory as a carrier for lubricant used during cold-working. Ni and/or Co are preferably used to increase the aggressive action of the baths on steel and to improve the phosphating of zinc surfaces. Small amounts of copper are accelerating. Alkali cations and/or ammonium are mainly used to adjust the desired acid ratio. The anions F, $BF_4$ and $SiF_6$ generally increase the phosphating rate and are desirable in the treatment of zinc surfaces which contain aluminum. In the formation of crystalline phosphate coatings on aluminum and its alloys, the presence of free fluoride ($F^-$) is essential. Cl may be used to make the baths electrically neutral and, in special cases, to increase the aggressive action of the baths. The thickness of the phosphate coatings which are produced and their weight per unit area can be influenced by the addition of polyhydroxycarboxylic acids, e.g. tartaric acid and/or citric acid.

The nature and quantity of anions and cations in the phosphating solutions used in the process in accordance with the present invention are adjusted such that the ratio of free $P_2O_5$ to total $P_2O_5$ is (0.04 to 0.50) : 1. Higher or lower ratios within the aforesaid range will be selected depending upon higher or lower bath temperatures and/or concentrations employed in the phosphating solutions, respectively.

To obtain a good coating, the concentration of Fe(II) should not exceed the concentration of zinc and the total concentration of Mg+Ca+Mn+Ni+Co should not exceed four times the concentration of zinc. In the present inventive process there will be no losses from the bath as a result of a mechanical discharge (drag out), and thus there will be no compensating action due to such bath losses. For this reason the proper selection of the replenishing substances is of special significance and the weight ratio of Zn : $NO_3$ $P_2O_5$ in the replenishing materials must be kept within the narrow range of (0.60 to 0.30) : (0.2 to 0.4) : 1. Additionally, if an addition is intended, the molar ratio of (Mg+Ca+Mn+Fe+Ni+Co+Cu) : Zn should not exceed 2:1.

The replenishing will be particularly effective if, in accordance with a further preferred feature of the invention, the metal surfaces are contacted with a phosphating solution which is replenished with materials in which the ratio of free $P_2O_5$ to total $P_2O_5$ is (−0.4 to +0 5) : 1. In the above definition of the ratio of free $P_2O_5$ to total $P_2O_5$ the minus sign means that there is no free $P_2O_5$ but part of the phosphate is present as secondary phosphate. For instance, a value of minus 0.19 means that 19% of the total $P_2O_5$ is present as secondary phosphate.

In accordance with another definition the content of phosphate components in the replenishing materials lies in a range which is limited on one end by 40% secondary phosphate and 60% primary phosphate (calculated as $P_2O_5$) and on the other end by 50% primary phosphate and 50% free phosphoric acid (calculated as $P_2O_5$).

If the ratio of free $P_2O_5$ to total $P_2O_5$ in the replenishment is equal to or higher than about 0.2 : 1, the replenishing ingredients will usually be added in an acid aqueous chemical concentrate. As liquid replenishing concentrates in which the ratio of free $P_2O_5$ to total $P_2O_5$ is below 0.2 : 1 are unstable, the replenishing will be effected in such case with at least two separate concentrates and the additions will suitably be so timed that the composition of the phosphating solution will remain at least substantially constant even when there are fluctuations in the throughput rate and, as a result, in the consumption. Certain parts of the required replenishing materials may be added to the bath separately from the replenishing concentrate proper. This may be applicable, e.g. to the addition of zinc oxide or zinc carbonate used to increase the zinc concentration and to correct the ratio of free $P_2O_5$ to total $P_2O_5$.

The oxidation accelerators used in the process in accordance with the invention consist only of $NO_3$, optionally together with oxygen-containing gas, $H_2O_2$ and/or nitrous gases. In baths which are autocatalytic on the nitrite side, i.e., in baths in Which the weight ratio of $NO_3$ to $P_2O_5$ exceeds 2:1, a small amount of nitrite, about 0.05 to about 0.15 g/l, e.g., as zinc nitrite or calcium nitrite, is preferably added at the beginning of the processing. A formation of nitrite from the nitrate may also be initiated by a short-time phosphating of zinc, zinc granules or zinc dust or by an initial phosphating of steel at a lower throughput rate. Alkali nitrite should be used to start the processing in the bath only in exceptional cases because this would result in an enriching of alkali to a disturbing degree.

Due to the absence of a surplus of nitrite or $H_2O_2$, Fe(II) will become enriched in baths used to treat iron and steel. An enriching of iron to disturbing degrees can be avoided by an intense contact of the solution with an oxygen-containing gas, such as air, and/or $H_2O_2$.

The phosphating step is succeeded by a cascade of at least two rinsing baths In the operation of the cascade of rinsing baths, fresh water is fed only to the last rinsing bath and an overflow to the preceding baths is effected. The resulting flow of rinsing water is opposite to the direction of travel of the workpieces. The concentrations of impurities in the several rinsing baths will differ and will depend on the feed rate of the fresh water, the rate of liquid entrained by the workpieces, the number of rinsing baths of the cascade and the concentration of the phosphating solution (see Table 1 below).

TABLE 1

Equilibrium concentration in case of a cascade rinsing in 1 to 6 stages
Concentration in the bath preceding the cascade: 50 g/l
Rate of liquid entrained by the workpieces: 30 ml/m$^2$
Rate of counterflowing liquid relative to surface area of workpieces: 200 ml/m$^2$ Calculated Concentrations of the Several Baths (g/l)

| | Number of Baths of Cascade | | | | | |
|---|---|---|---|---|---|---|
| Bath | 1 | 2 | 3 | 4 | 5 | 6 |
| 1 | 6.522 | 7.356 | 7.478 | 7.497 | 7.500 | 7.500 |
| 2 | — | 0.959 | 1.100 | 1.121 | 1.124 | 1.125 |
| 3 | — | — | 0.144 | 0.165 | 0.168 | 0.169 |
| 4 | — | — | — | 0.022 | 0.025 | 0.025 |
| 5 | — | — | — | — | 0.003 | 0.004 |
| 6 | — | — | — | — | — | 0.000 |

In the process in accordance with the invention, low-salt or salt-free water is removed form the phosphating bath by a suitable process at least at such a rate that the high-phosphate overflow from the cascade can be fed to the phosphating bath.

The characteristic date of the cascade (number of stages, rate of counterflowing liquid entrained by the workpieces) must so be selected that the last rinsing bath has a purity which is sufficient in view of the technical requirements for the further treatments. The effectiveness of a cascade of rinsing baths can be increased if there is no direct overflow from one bath to the preceding one but the overflow is first sprayed on the workpieces leaving the preceding bath before the liquid is fed to the rinsing bath.

Further preferred features of the process in accordance with the invention reside in that the salt-free or low-salt water is recovered from the phosphating bath by a single- or multiple-effect evaporation, reverse osmosis or electrodialysis and said water is fed as fresh water to the cascade of rinsing baths.

In accordance with a further preferred feature, the phosphate-containing rinsing waters from the cascade of rinsing baths are concentrated, particularly by an evaporation, electrodialysis or reverse osmosis, before said waters are fed to the phosphating bath.

The phosphating treatment of the present inventive process results in a bath sludge, which is removed from the system continuously or from time to time, e.g., by sedimentation, filtration and the like. The aforesaid wet sludge contains 50% to 90% adhering phosphating solution. In accordance with a further preferred embodiment of the invention the consumption of chemicals and the rate of waste water are decreased in that said phosphate sludge which has been removed is washed with water, which is then fed to the cascade of rinsing baths or directly to the phosphating bath. The phosphate sludge may be washed with rinsing water from the several rinsing baths in a plurality of stages, which may constitute a cascade, if desired.

It will be particularly desirable to wash the phosphate sludge in a plurality of stages with the water from the cascade of rinsing baths and to feed the used wash water to the cascade of rinsing baths or directly to the phosphating bath.

The invention will be explained by way of example and in more detail with reference to the following Examples. It is to be understood, however, that such examples are for illustrative purposes only and are not intended to limit the scope or spirit of the specification or claims in any way.

EXAMPLE 1

Bright steel sheets were degreased by being dipped into an aqueous cleaner and were subsequently rinsed with water. The thus prepared specimens were phosphated for 10 minutes at 90° C. by being dipped into an aqueous solution composed of, 21.6 g/l $P_2O_5$
28.6 g/l Zn
0.028 g/l Ni
42.2 g/l $NO_3$
Free $P_2O_5$=7.8
Total $P_2O_5$=21.6
Free $P_2O_5$/ total $P_2O_5$=0.36
Number of points : 80

The phosphating step was succeeded by rinsing in a cascade of 3 stages. An evaporation of 0.2 1/m$^2$ of the treated steel surface was effected from the phosphating bath during the throughput of material. Salt-free water at a rate of 0.2 1 per m$^2$ of treated steel surface area was fed to the last rinsing bath (3) of the cascade. The resulting overflow was subsequently fed to the second rinsing bath (2), the first rinsing bath (1) and finally to the phosphating bath in succession.

To maintain the phosphating bath at a constant number of points, the phosphating bath was replenished with a concentrate composed of 25% $P_2O_5$
6.25% $NO^3$
12.5% Zn
0.03% Ni
Free $P_2O_5$ total $P_2O_5$=0.2
Zn : $NO_3$ $P_2O_5$–0.5 : 0.25 : 1

Air was stirred into the phosphating bath during the throughput to keep the Fe(II) concentration at or below 5 g/l.

Under steady-state conditions after a throughput of a substantial amount of material, the following numbers of points were obtained in the rinsing baths Rinsing bath 1: 12 points
Rinsing bath 2: 1.8 points
Rinsing bath 3: 0.2 points The steady-state composition of the phosphating solution was as follows:

20.5 to 23 g/1 $P_2O_5$ 22 to 24 g/l Zn
4 to 5 g/l Fe(II)
41 to 43 g/l $NO_3$
Free $P_2O_5$ total $P_2O_5$ =0.32 to 0.46

From the experiment it is apparent that the process in accordance with the invention can be carried out in such a manner that satisfactory phosphate coatings are formed; the concentration of the phosphating solution is maintained constant; there will be no contaminated waste water produced from rinsing baths; and the last rinsing bath will be operated with a lower salt concentration (0.2 points corresponding to 0.23 g/l salt).

EXAMPLE 2

Various phosphating bath compositions and replenisher concentrates which can be used in the process in accordance with the invention have been complied as summarized below in Table 2.

TABLE 2

| | | 1 | 2 | 3 | 4 |
|---|---|---|---|---|---|
| Bath composition | | | | | |
| Zn | (g/l) | 17 | 10.2 | 16.8 | 11 |
| Mn | (g/l) | — | 9.2 | — | — |
| Ni | (g/l) | 0.03 | 0.02 | 0.02 | — |
| Ca | (g/l) | — | — | — | 11 |
| Cu | (g/l) | — | — | 0.003 | — |
| Na | (g/l) | — | — | 2.6 | 1.1 |
| Fe(II) | (g/l) | 2.5 | 5.0 | 1.5 | — |
| $P_2O_5$ | (g/l) | 23.5 | 20 | 14.6 | 22 |
| $NO_3$ | (g/l) | 24.9 | 39.2 | 32 | 44 |
| F | (g/l) | — | — | 0.6 | — |
| Free $P_2O_5$: total $P_2O_5$ | | 0.37 | 0.31 | 0.35 | 0.28 |
| Replenishing concentrates | | | | | |
| Zn | (%) | 9 | 8 | 10 | 5.8 |
| Mn | (%) | — | 0.8 | — | — |
| Ni | (%) | 0.02 | 0.01 | 0.01 | — |
| Ca | (%) | — | — | — | 1.8 |
| Cu | (%) | — | — | 0.02 | — |
| Na | (%) | — | — | — | — |
| $P_2O_5$ | (%) | 18 | 20 | 18 | 19 |
| $NO_3$ | (%) | 4.5 | 7 | 6.1 | 4.9 |
| F | (%) | — | — | 0.2 | — |
| Free $P_2O_5$: total $P_2O_5$ | | 0.20 | 0.43 | 0.22 | 0.30 |

What is claimed is:

1. A process for forming a phosphate coating on a metal surface, comprising contacting said metal surface with an Fe(II) containing phosphating solution comprising from 0.4 to 30 g/l Zn;
from 4 to 30 g/l $P_2O_5$;
from 5 to 50 g/l $NO_3$;
from greater than 0 to 10 g/l Fe(II);
from greater than 0 to 0.3 g/l Fe(III);

wherein the weight ratio of free $P_2O_5$ to total $P_2O_5$ is (0.04 to 0.50) : 1, and replenishing said phosphating solution with Zn, $NO_3$ and $P_2O_5$ in a weight ratio of, Zn : $NO_3$ : $P_2O_5$=(0.80 to 0.30) : (0.17 to 0.4) : 1; wherein the Fe(II) content is adjusted by an oxidation with nitrate or nitrite derived from nitrate, optionally employed with an oxygen-containing gas, $H_2O_2$ and/or nitrous gases, then rinsing said metal surface by a cascade of at least two aqueous rinsing baths in the opposite direction of travel of said metal surface wherein water having a low salt content or being salt-free an derived from the phosphating bath is fed to the last rinsing bath and the overflowing water from said rinsing bath is fed to the next preceding rinsing bath and ultimately to the phosphating bath, respectively, and the low-salt content or salt-free rinse water derived from the phosphating bath is withdrawn therefrom at a rate effective to permit the addition of phosphate-enriched rinsing water from the cascade of rinsing water to the phosphating bath while maintaining a desired species concentration in said phosphating bath.

2. A process according to claim 1, wherein said phosphating solution additionally contains from greater than 0 to 10 g/l Mg;
from greater than 0 to 20 g/l Ca;
from greater than 0 to 20 g/l Mn;
from greater than 0 to 20 g/l Ni;
from greater than 0 to 10 g/l Co;
from greater than 0 to 0.02 g/l Cu;
from greater than 0 to 20 g/l of a species selected from the group consisting of Na, K and $NH_4$;

from greater than 0 to 8 g/l $SiF_6$;
from greater than 0 to 8 g/l $BF_4$;
from greater than 0 to 5 g/l F; and
from greater than 0 to 10 g/l Cl;

3. A process according to claim 1 or 2, wherein in said phosphating solution the ratio of Fe(II) : Zn is 1:1 or less, and the ratio of (Mg+Ca+Mn+Ni+Co) : Zn is 4:1 or less.

4. A process according to claim 1, wherein said phosphating solution is replenished with a species selected from the group consisting of Mg, Ca, Mn, Ni, Fe, Co and Cu with a molar ratio (Mg+Ca+Mn+Fe+Ni+Co+Cu) : Zn of 2:1 or less.

5. A process according to claim 3, wherein said phosphating solution is replenished with a species selected from the group consisting of Mg, Ca, Mn, Ni, Fe, Co and Cu with a molar ratio (Mg+Ca+Mn+Fe+Ni+Co+Cu) : Zn of 2:1 or less.

6. A process according to claim 4, wherein said phosphating solution is replenished by an addition of phosphate in a ratio of free $P_2O_5$ to total $P_2O_5$ of (−0.4 to +0.5) : 1 during replenishment.

7. A process according to claim 5, wherein said phosphating solution is replenished by an addition of phosphate in a ratio of free $P_2O_5$ to $P_2O_5$ of (−0.4 to +0.5) : 1 during replenishment.

8. A process according to claim 8 wherein said low-salt or salt-free water removed from the phosphating bath is fed as fresh water to the cascade of rinsing baths.

9. A process according to claim 9 wherein said low-salt or salt-free water removed from the phosphating bath is fed as fresh water to the cascade of rinsing baths.

10. A process according to claim 8 wherein substances from the cascade of rinsing bath effective for phosphating are concentrated prior to being fed to the phosphating bath.

11. A process according to claim 10 wherein sludge formed in the phosphating bath is removed and is then washed with water, and said wash water is fed to the cascade of rinsing baths or directly to the phosphating bath.

12. A process according to claim 11 wherein sludge formed in the phosphating bath is removed and is then washed with water, and said wash water is fed to the cascade of rinsing baths or directly to the phosphating bath.

13. A process according to claim 11, wherein said phosphate sludge is washed in a plurality of stages with water from the cascade of rinsing baths.

14. A process according to claim 12, wherein said phosphate sludge is washed in a plurality of stages with water from the cascase of rinsing baths.

15. A process for forming a phosphate coating on a metal surface, comprising contacting said metal surface with an Fe(II) containing phosphating solution comprising, from 0.4 to 30 g/l Zn;
from 4 to 30 g/l $P_2O_5$;
from 5 to 50 g/l $NO_3$;
from greater than 0 to 10 g/l Fe(II); and
from greater than 0 to 0.3 g/l (Fe(III), wherein the weight ratio of free $P_2O_5$ to total $P_2O_5$ is (0.04 to 0.50) : 1, and replenishing said phosphating solution with Zn, $NO_3$ and $P_2O_5$ in a weight ratio of Zn : $NO_3$ : $P_2O_5$=(0.80 to 0.30) : (0.17 to 0.4) : 1, and further replenishing said phosphating solution with a compound selected from the group consisting of Mg, Ca, Mn, Ni, Fe, Co and Cu, with a molar ratio of (Mg+Ca+Mn+Ni+Fe+Co+Cu) : Zn of 2:1 or less, of phosphate in a ratio of free $P_2O_5$ to total $P_2O_5$ of (−0.4 to +0.5) : 1 during replenishment, and wherein the Fe(II) content is adjusted by an oxidation with nitrate or nitrite derived from nitrate, optionally employed with an oxygen-containing gas, $H_2O_2$ and nitrous gases, then rinsing said metal surface by a cascade of at least two aqueous rinsing baths in the opposite direction of travel of said metal surface, wherein water having a low salt content or being salt-free and derived from the phosphating bath is fed to the last rinsing bath and the overflowing water from said rinsing bath is fed to the next preceding rinsing bath and ultimately to the phosphating bath, respectively, and the low salt content or salt-free rinse water derived from the phosphating bath is withdrawn therefrom at a rate effective to permit the addition of phosphate-enriched rinsing water from the cascade of rinsing water to the phosphating bath while maintaining a desired species concentration in said phosphating bath, and further wherein rinse water having a low-salt content or salt-free water is removed from said phosphating bath by a process selected from the group consisting of a single effect evaporation, multiple effect evaporation, reverse osmosis and electrodialysis.

16. A process according to claim 14, wherein said phosphating solution additionally contains, in the stated amounts, a species selected form the group consisting of, from greater than 0 to 10 g/l Mg;
from greater than 0 to 20 g/l Ca;
from greater than 0 to 20 g/l Mn;
from greater than 0 to 20 g/l Ni;
from greater than 0 to 10 g/l Co;
from greater than 0 to 0.02 g/l Cu;
from greater than 0 to 20 g/l of a species selected from the group consisting of Na, K and $Nh_4$;
from greater than 0 to 8 g/l $SiF_6$;
from greater than 0 to 8 g/l $BF_4$;
from greater than 0 to 5 g/l F; and
from greater than 0 to 10 g/l Cl.

17. A process according to claim 15, wherein in said phosphating solution the ratio of Fe(II) : Zn is 1:1 or less, and the ratio of (Mg+Ca+Mn+Ni+Co) : Zn is 4:1 or less.

18. A process according to claim 16, wherein in said phosphating solution the ratio of Fe(II) : Zn is 1:1 or less, and the ratio of vp a 5393000

(Mg+Ca+Mn+Ni+Co) : Zn is 4:1 or less.

* * * * *

UNITED STATES PATENT AND TRADEMARK OFFICE

CERTIFICATE OF CORRECTION

PATENT NO. : 5,203,930

DATED : April 20, 1993

INVENTOR(S) : George Blumlhuber et al

It is certified that error appears in the above-indentified patent and that said Letters Patent is hereby corrected as shown below:

| | |
|---|---|
| Col. 2, line 33 | "$P_2O_5$" not "$P_{25}$" |
| Col. 2, line 37 | "$Zn:NO_3:P_2O_5$" not "$ZnNO_3P_2O$" |
| Col. 4, line 65 | "which" not "Which" |
| Col. 8, line 54 | "claim 2" not "claim 8" |
| Col. 8, line 57 | "claim 2" not "claim 9" |
| Col. 8, line 60 | "claim 2" not "claim 8" |
| Col. 8, line 64 | "claim 2" not "claim 10" |

UNITED STATES PATENT AND TRADEMARK OFFICE

CERTIFICATE OF CORRECTION

PATENT NO. : 5,203,930

DATED : April 20, 1993

INVENTOR(S) : George Blumlhuber et al

It is certified that error appears in the above-indentified patent and that said Letters Patent is hereby corrected as shown below:

| | |
|---|---|
| Col. 9, line 1 | "claim 2" not "claim 11" |
| Col. 9, line 6 | "claim 2" not "claim 11" |
| Col. 9, line 9 | "claim 2" not "claim 12" |
| Col. 10, line 15 | "claim 14" not "claim 15" |
| Col. 10, line 26 | "$Nh_4$" not "$NH_4$" |
| Col. 10, line 39 | "vp a 5393000" should be deleted |

Signed and Sealed this

Sixth Day of September, 1994

*Attest:*

*Attesting Officer*

BRUCE LEHMAN

*Commissioner of Patents and Trademarks*